United States Patent [19]

Hurst

[11] Patent Number: 4,806,828

[45] Date of Patent: Feb. 21, 1989

[54] HIGH PRESSURE SODIUM DISCHARGE LAMPS WITH HYDROGEN GETTER

[75] Inventor: Derek P. Hurst, Leicestershire, England

[73] Assignee: Thorn EMI plc, London, England

[21] Appl. No.: 47,274

[22] Filed: May 8, 1987

[30] Foreign Application Priority Data

Jul. 2, 1986 [GB] United Kingdom ..... 8616148

[51] Int. Cl.[4] ..... H01J 61/26

[52] U.S. Cl. ..... 313/558; 313/562; 252/181.2; 252/181.6

[58] Field of Search ..... 313/558, 559, 561, 562, 313/638, 625, 25; 252/181.2, 181.6, 181.1; 47/51

[56] References Cited

U.S. PATENT DOCUMENTS 3,620,645 11/1971 Porta ..... 417/48
3,926,832 12/1975 Barosi ..... 252/181.6
4,599,543 7/1986 Strok ..... 313/25 X

FOREIGN PATENT DOCUMENTS 2125615 8/1983 United Kingdom .

*Primary Examiner*—David K. Moore
*Assistant Examiner*—K. Wieder
*Attorney, Agent, or Firm*—Fleit, Jacobson, Cohn & Price

[57] ABSTRACT

An arc tube (13) for a high pressure sodium discharge lamp (10) contains a quantity of a getter materal which comprises an alloy of titanium and niobium metal. The alloy is in the form of a coiled wire (31) which is wound on a tungsten electrode shank (29). The wire may have a sheath of niobium metal.

21 Claims, 1 Drawing Sheet

(400W)

(70W)

HIGH PRESSURE SODIUM DISCHARGE LAMPS WITH HYDROGEN GETTER

This invention relates to high pressure sodium discharge lamps more particularly to high pressure sodium discharge lamps having a discharge arc tube closed by one or more cermet ends. In our UK patent GB No. 2125615B we described how electrically conducting cermet members may be used as an alternative to conventional tubular niobium lead-in members and, in this case, depending on the permeability of the electrically conducting cermets to hydrogen an alternative means of removing or rendering residual hydrogen in the arc tube ineffecitve has to be found. According to our above mentioned patent GB No. 2125615B which discloses a 400W lamp one solution is to provide a getter to absorb the hydrogen which can be in the form of a coil of titanium wire and in some cases the titanium wire can be covered with a hydrogen permeable material. This protects the titanium from sodium attack which otherwise would cause an unacceptable voltage rise throughout the life of the lamp. A preferred material is niobium because of its high permeability to hydrogen and excellent resistance to sodium attack. One suggested method of achieving this is by co-drawing a titanium core wire with a niobium outer sheath. While a co-drawn composite wire can be used in the context of the aforementioned 400 Watt Lamp the co-drawing of such composite wire and especially the coiling of such wire has not proved a totally satisfactory solution especially when developing a range of lamps of low wattage, typically in the range 35–70 watts and has even proved problematical for lamps of up to 150 Watts. Because of the different crystal structure of the titanium and the niobium the co-drawn composite wire tends to become work hardened and brittle and attempts to coil this composite wire usually result in fracture of the coil such that the coil is no longer held captive on the electrode shank. Having pieces of titanium wire free within the arc tube is not desirable and can be detrimental to lamp performance. Moreover, the problem is exacerbated because, whereas the 70W is dimensionally much smaller than the 400W lamp because of different production techniques and especially the sealing process, there is a substantially increased amount of hydrogen in the 70W arc tube to be gettered.

According to the present invention there is provided an arc tube of light transmitting ceramic material for a high pressure discharge lamp, the arc tube including spaced electrodes for supporting a discharge there between and a quantity of getter material comprising an alloy of titanium and niobium metal held captive within the arc tube.

In a preferred embodiment of the invention the alloy is drawn down to a diameter of 0.3 mm and coiled to fit either a 0.51 mm and or 0.71 mm diameter electrode shank. Suprisingly it has been found that drawn alloy wire as small as 0.3 mm diameter can be successfully coiled without any work hardening effect and, more surprisingly, the titanium does not lose its gettering effect despite the alloying effect of the niobium. Moreover the niobium still exhibits good resistance to sodium attack despite the diluting effect of the titanium.

In a further preferred embodiment of the invention the titanium/niobium alloy is co-drawn with a niobium outer sheath to provide a composite alloy wire. It has been found that the resulting composite alloy wire can be successfully coiled to form a fully closed coil.

One embodiment of the invention will now be described by way of example only and with reference to the accompanying drawings wherein.

Figure 1:
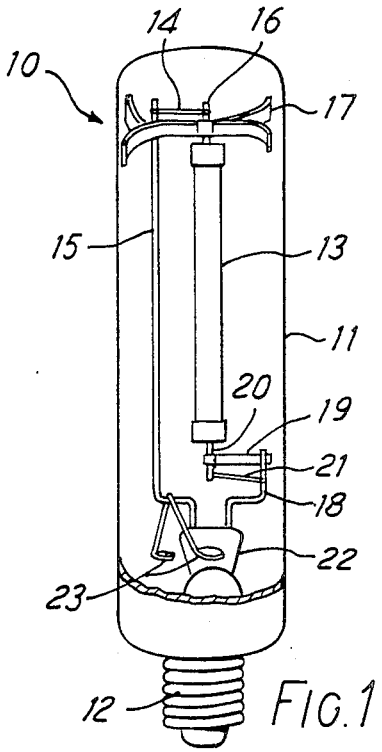
FIG. 1 is a general view of a 70Watt high pressure sodium discharge lamp embodying the invention.

A 70 Watt high pressure sodium vapor discharge lamp 10 embodying the invention is shown in FIG. 1. This comprises an outer envelope 11 of soda lime glass fitted to an edison screw end portion 12 forming a base for the lamp 10. The envelope 11 contains a light transmitting alumina arc tube 13 suspended from a cross part 14 attached to vertical support rod 15 which forms a main electrical inlead for lamp 10. The cross part 14 is welded to the arc tube electrical inlead 16 projecting from the top end of arc tube 13 and the arc tube 13 is properly centred within the envelope 11 by means of spring brackets 17 pressing against the sides of envelope 11.

The bottom end of the arc tube 13 is supported by the other lamp electrical inlead 18 and cross part 19 welded thereto.

An arc tube electrical inlead 20 projects from the bottom end of the arc tube 13 and cross part 19 is arranged to be a sliding fit around arc tube inlead 20. A flexible conductive wire 21 is attached between lamp inlead 18 and arc tube inlead 20 and this arrangement allows for movement of the components due to temperature expansion effects. Both lamp electrical inleads 15, 18 project through and are supported by lead alkali silicate glass stem 22. Gettering devices in the form of rings 23 containing barium are welded to lamp inlead 15 and are included to maintain a high vacuum within glass outer envelope 11. The discharge arc tube 13 contains the usual fill for a high pressure sodium lamp comprising a sodium and mercury amalgam plus an inert gas to aid starting. Conventionally gettering devices 23 would absorb small amounts of hydrogen transported through arc tube lead-in members 16 and 20 provided these lead in members were made of niobium. In the present invention hydrogen in the discharge arc tube 13 is rendered ineffective by different means about to be described.

The present invention is best explained with reference to FIGS. 2 and 3 which illustrate respectively to the same scale an electrode assembly for a 400W and 70W high pressure sodium discharge lamp.

Figure 2:
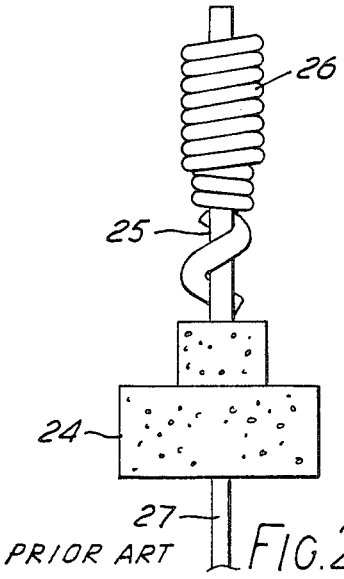
PRIOR ART FIG. 2
FIG. 2 illustrates an electrode assembly for a prior art 400 Watt high pressure sodium discharge lamp.
Figure 3:
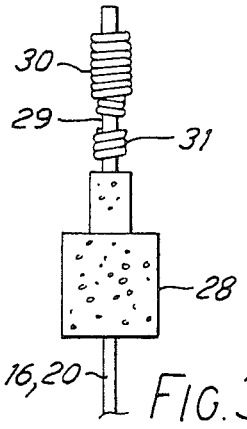
FIG. 3 illustrates a comparable electrode assembly for a 70 Watt high pressure sodium discharge lamp in accordance with the invention.

The 400W electrode assembly, FIG. 2 comprises an electrically conducting cermet member 24 to which is attached a tungsten electrode shank 25, tungsten electrode 26 and arc tube electrically conductive inlead 27. FIG. 3 shows a comparable electrode assembly for a 70W high pressure sodium lamp comprising an electrically conducting cermet member 28 to which is attached tungsten electrode shank 29 complete with tungsten electrode 30 and arc tube electrical inlead, 16 or 20 mentioned with reference to FIG. 1. The difference in size is evident which gives rise to various problems.

In our UK patent GB No. 2125615B, mentioned above, it was indicated that in order to maintain the rise in voltage within acceptable limits over the life of the lamp it was desirable to cover the titanium coil with a hydrogen permeable material, such as, niobium and this could be done by providing a coil of co-drawn wire having a titaniumcore and niobium outer sheath. In practice it was found difficult to coil the co-drawn wire because of a work hardening effect which tended to make the wire brittle and liable to fracture. A slow spiral such as illustrated in FIG. 2 to give some attachment to shank 25 could be attempted but it was found preferable to weld straight lengths of the co-drawn wire around the periphery of the electrode shank 25. In the case of the 400W there was sufficient space between the bottom of the electrode 26 and the top of the boss on the cermet 24 to do this. Moreover the bulk of the electrode shank 25 was sufficiently large to absorb the heat energy on welding without becoming deformed or work hardened even if two, maybe even three lengths had to be added to provide sufficeint gettering material. This, of course, results in four to six cut ends exposing titanium and the possibility of sodium attack leading to increase voltage rise during life. This solution is not possible with the electrode assembly for the 70W, shown in FIG. 3, where there is a 40% to 50% reduction in shank size so that there is no possibility of providing a sufficiently long straight length of co-drawn wire, moreover, the reduced shank size 29 makes it difficult to weld lengths of wire around the shank periphery. In addition the smaller shank diameter cannot withstand the heat energy on welding without deforming. In accordance with the present invention and as shown in FIG. 3 a hydrogen getter is provided as a coil 31 of a titanium/niobium alloy and is an alloy which has been developed as a superconductor. It is somewhat surprising, therefore that this alloy which has been developed for such low temperature application should each fit this particular combination of machinery as gettering properties in the high temperature environment of a high pressure discharge lamp.

Figure 4:
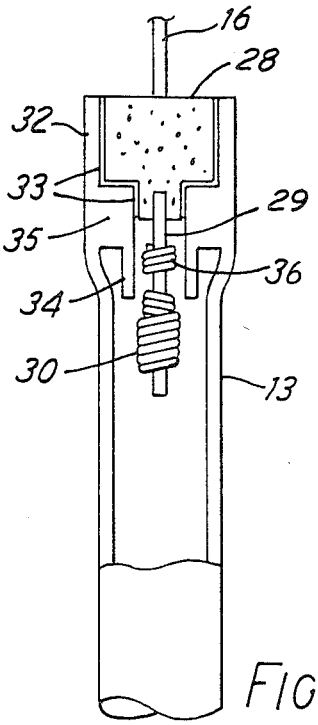
FIG. 4 illustrates one end of a discharge arc tube in accordance with the present invention.

In FIG. 4 there is shown one end of the discharge arc tube 13 of FIG. 1 which comprises usually the last of the two ends to be sealed. Both ends could incorporate the getter coil if thought desirable. The discharge arc tube 13 is made of light transmitting polycrystalline aluminum material and is cut away to shown the electrode assembly sealed within the end 32 of arc tube 13. Electrically conductive cermet member 28 is sealed within the end 32 by means of a suitable sealing material 33. An electrode shank 29, embedded in cermet 28 by sintering carries electrode 30 to which has been applied a barium calcium tungstate/tungsten emitter. A shoulder member 34 formed on the body portion 35 of arc tube 13 prevents rectification during starting.

Shank 29 also carries a getter which is a fully closed coil 36 of a titanium/niobium alloy and is an alloy which has been developed as a superconductor. It is somewhat surprising, therefore that this alloy which has been developed for such low temperature application should each fit this particular combination of machinery as gettering properties in the high temperature environment of a high pressure discharge lamp. In this particular case the alloy is 46% titanium and 54% niobium by weight. It is believed an alloy with between 25 to 75% titanium by weight would be equally effective. The coil 31 is coiled around the shank 29 being initially attached to the shank by a spot of welded metal. In this particular case the getter coil 36 is titanium/niobium alloy core co-drawn width a niobium outer sheath formed into four turns of fully closed coil. It has been found that it is possible to form such a coil wherein the problem of springback has been overcome, so that the coil will fit properly within body portion 35. It has been found that the titanium/niobium alloy can be co-drawn with a niobium outer sheath such that a composite getter is formed having none of the defects of the getter made from a titanium wire co-drawn with niobium wire. The alloy composite getter has been drawn down to 0.3 mm diameter and successfully coiled into a fully closed coil with no work hardening for attachment to a 0.71 mm or 0.51 mm diameter tungsten shank.

In a 70W lamp embodying the invention the bore of the arc tube 13 is norminally 4mm having an internal length of 40–45 mm. The electrically conducting cermet member 28 is described in greater detail in our UK Pat. No. 1571084 and comprises 30 parts by weight of molybdenum and 100 parts by weight of alumina. The arc tube 13 has a fill made up of 15 mg of mercury, sodium amalgam made up of 22% sodium and 78% mercury and up to 25 torr of Xenon (at room temperature) is included to aid starting.

It is emphasised that the present invention is particularly useful in the case where each end of the arc tube is closed by a electrically conductive cermet member or where only one end is closed by such a cermet, but it can be useful in any arc tube end assembly where the efficiency of hydrogen diffusion from the arc tube is less than that provided by conventional niobium tubular in leads.

I claim:

1. An arc tube of light transmitting ceramic material for a high pressure sodium discharge lamp, the arc tube including spaced electrodes for supporting a discharge therebetween and a quantity of getter material comprising an alloy of titanium and niobium metal held captive within the arc tube.

2. An arc tube according to claim 1 wherein the alloy is in the form of a coiled wire.

3. An arc tube according to claim 2 wherein the wire coil is covered with hydrogen permeable material.

4. An arc tube according to claim 1 wherein at least one end of the arc tube is closed by an electrically conductive cermet member.

5. An arc tube according to claim 4 wherein each end of the arc tube is closed by an electrically conductive cermet member.

6. An arc tube according to claim 1 for a high pressure discharge lamp of up to 150 watts.

7. An arc tube according to claim 6 for a high pressure discharge lamp of between 35 and 70 Wattage.

8. An arc tube according to claim 3 wherein the hydrogen permeable material is co-drawn with a core wire of titanium/niobium alloy.

9. An arc tube according to claim 3 wherein the hydrogen permeable material is niobium.

10. An arc tube for a high pressure sodium discharge tube according to claim 1 wherein the getter material is in the form of a fully closed coil placed around an electrode shank.

11. An arc discharge tube similar for a high pressure sodium discharge lamp, the arc tube being made of a light-transmissive ceramic material and including spaced electrodes for supporting a discharge therebetween and a quantity of a getter material held captive within the arc tube, the getter material comprising an alloy of titanium and niobium metal, the titanium content of the alloy being in the range from 25% by weight to 75% by weight.

12. An arc discharge tube according to claim 11 wherein the alloy comprises 46% by weight of titanium and 54% by weight of niobium.

13. An arc discharge tube according to claim 11 or claim 12 wherein said quantity of getter material is in the form of a coiled wire.

14. An arc discharge tube according to claim 13 wherein said quantity of getter material is in the fo rm of a coiled wire placed around an electrode shank.

15. An arc discharge tube according to claim 14 wherein said coiled wire has an outer sheath of a hydrogen permeable material.

16. An arc discharge tube according to claim 15 wherein said outer sheath of a hydrogen permeable material is co-drawn with a core wire of said titanium/-niobium alloy.

17. An arc discharge tube according to claim 15 wherein said hydrogen permeable material is niobium.

18. An arc discharge tube according to claim 11 wherein at least one end of the arc tube is closed by an electrically conductive cermet member.

19. An arc tube according to claim 18 where each end of the arc tube is closed by an electrically conductive cermet member.

20. An arc discharge tube according to claim 11 suitable for a high pressure discharge lamp of up to 150 watts.

21. An arc discharge tube according to claim 20 suitable for a high pressure discharge lamp of from 35 watts to 70 watts.

* * * * *